US005107562A

United States Patent [19]

Dunn

[11] Patent Number: 5,107,562

[45] Date of Patent: Apr. 28, 1992

[54] DISPOSABLE FINGER-MOUNTED TOOTHBRUSH WITH HOLDING MEANS

[76] Inventor: Gary D. Dunn, 2368 Podocrapus Way, Clearwater, Fla. 34619

[21] Appl. No.: 713,914

[22] Filed: Jun. 12, 1991

[51] Int. Cl.[5] ..... A47K 7/02

[52] U.S. Cl. ..... 15/167.1; 15/227; 206/229; 206/361

[58] Field of Search ..... 15/167.1, 227; 206/216, 206/229, 361

[56] References Cited

U.S. PATENT DOCUMENTS

| | | | |
|---|---|---|---|
| 2,121,701 | 6/1938 | Landers | 206/361 X |
| 3,070,102 | 12/1962 | MacDonald | 15/227 X |
| 3,298,507 | 1/1967 | Micciche | 15/227 X |
| 3,368,668 | 2/1968 | Micciche | 15/167.1 X |
| 3,534,887 | 10/1970 | Ginsberg | 206/229 X |
| 3,675,264 | 7/1972 | Storandt | 15/227 X |
| 3,952,867 | 4/1976 | McCord | 206/229 |
| 4,134,172 | 1/1976 | Arce | 15/227 X |
| 4,620,528 | 11/1986 | Arraval | 15/227 X |

*Primary Examiner*—Chris K. Moore

*Attorney, Agent, or Firm*—Joseph C. Mason, Jr.; Ronald E. Smith

[57] ABSTRACT

A toothbrush of the type worn on a human finger. The toothbrush includes an inner part that is wholly received within an outer part when the toothbrush is in a stored condition prior to use. The outer part includes an upper flap and a lower flap that are releasably secured to one another about their respective peripheral borders so that when the top flap is peeled back, the bottom flap separates from the top flap and the inner part of the toothbrush, upon which are mounted the bristles of the brush, is exposed. The user of the device grasps the lower flap after it has separated from the upper flap, and this grasping maintains the toothbrush on the user's finger throughout the time the toothbrush is in use.

7 Claims, 4 Drawing Sheets

DISPOSABLE FINGER-MOUNTED TOOTHBRUSH WITH HOLDING MEANS

TECHNICAL FIELD

This invention relates, generally, to finger-mounted toothbrushes. It includes a non-rigid handle means for holding the toothbrush onto the finger of the user so that it does not slip off during use.

BACKGROUND ART

U.S. Pat. No. 4,134,172 to Arce discloses a flexible, finger-mounted toothbrush including an elongate flexible bag member with a closed distal end and an open proximal end. Its bristles are covered by folding the device in half but such folding does not seal the bristles from the ambient environment. The tight fit of the device on the finger prevents the device from slipping from the user's finger during use.

Lerner (U.S. Pat. No. 4,788,733) shows a mitten-like device that is folded inside-out momentarily as it is being turned inside-out after use. It has no sanitized parts and, accordingly, no means are provided to maintain any part thereof in a sanitary condition.

Pipkin (U.S. Pat. No. 4,602,650) discloses a cylindrical finger-mounted paint brush that is stored in a configuration that is partially inside out; it is held on the user's finger by the tight fit of the elastomeric finger-receiving part thereof, and the bristles are always exposed to the ambient environment.

Thus, a consumer desiring to purchase a flexible, finger-mounted toothbrush that is maintained in a clean, sanitary condition up to the time of use and which will not slip from the finger when used will not be able to fulfill said desire. Significantly, no combination of the existing devices can produce a device that would meet the consumer's requirements.

DISCLOSURE OF INVENTION

The longstanding but heretofore unfulfilled need for a finger-mounted toothbrush meeting all of the above mentioned needs and more is now fulfilled. The novel toothbrush is formed of a flexible material that is flat when stored in either of two stored configurations so that it takes up a nominal amount of space. It has a length substantially equal to that of a human finger when in a first stored configuration and about half that length when in a second stored configuration. When fully deployed and worn on a finger, it has a length about twice that of a finger.

The device can perhaps be best thought of as having an inner part and an outer part, both of which have substantially the same length; the latter part overlies the former when the device is stored in its partially inside-out configuration. Thus, the device provides its own packaging; the outer part provides a protective, sealed covering for the inner part. When the "package" is unsealed and opened, one-half of the outer part becomes the handle which is naturally grasped by the user to hold the toothbrush onto the finger during use. A second half of the outer part overlies a knuckle and part of the back of the user's hand, thereby providing a shield that prevents the covered part of the hand from contacting the mouth during brushing.

Bristles for brushing teeth are carried near the distal end of the inner part and are maintained in a sanitary condition during the time the device is stored because the outer part is sealed about its periphery so that no dirt or debris can contact the bristles. The seal may be a heat seal, or an adhesive seal of the type broken by pulling a string.

The device is used by slipping the open end of the inner part onto a finger and by peeling back a pull tab integral with the outer part to expose the inner part. When the outer part is peeled back, the seal about the periphery of the outer part is broken, and the outer part is separated into two elongate flap members, one of which is grasped by the user of the device to maintain the device into operative position on the user's finger, and the other of which overlies a part of the user's hand as mentioned above.

The inner part of the device takes the form of a flexible bag member that does not fit tightly around the finger of the user so that one size fits all fingers. The loose fit also enables the device to be slipped on and off easily, and the flexibility enables the device to remain flat when stored prior to use. The seal around the perimeter of the outer part maintains the sanitary condition of the bristles while the device is in storage, and the ease with which the outer cover is peeled back to expose the bristles ensures that consumers will enjoy using the device. The manner in which the outer part separates into two flaps, one of which is naturally grasped by the user, ensures that the device will not slip off inadvertently, thereby overcoming the shortcomings of earlier devices in this field of invention.

In a second storage configuration, the device, beginning in its first storage configuration, is folded along a transverse folding line formed mid-length of the device so that it is only about one-half the length of a finger when so folded. A light adhesive may be added to hold the pull tab in overlying relation to the open end of the device when the device is in said second stored configuration. This serves to hold closed said open end.

A pull string may also be employed to open the device.

In all embodiments, the toothbrush is used one time and discarded.

It will now be understood that the primary object of this invention is to provide a flexible, one size fits all, finger-mounted disposable toothbrush having clean, sanitary bristles.

Another important object is to provide such a toothbrush that includes means for holding it onto a finger when in use.

Still another object is to provide a disposable, economical toothbrush that is stored in a flat condition and that is used only one time so that a consumer may maintain a supply thereof in a purse or billfold.

Yet another object is to provide a completely flexible toothbrush that eliminates the rigid handle found in most standard and travel toothbrushes.

These and many other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
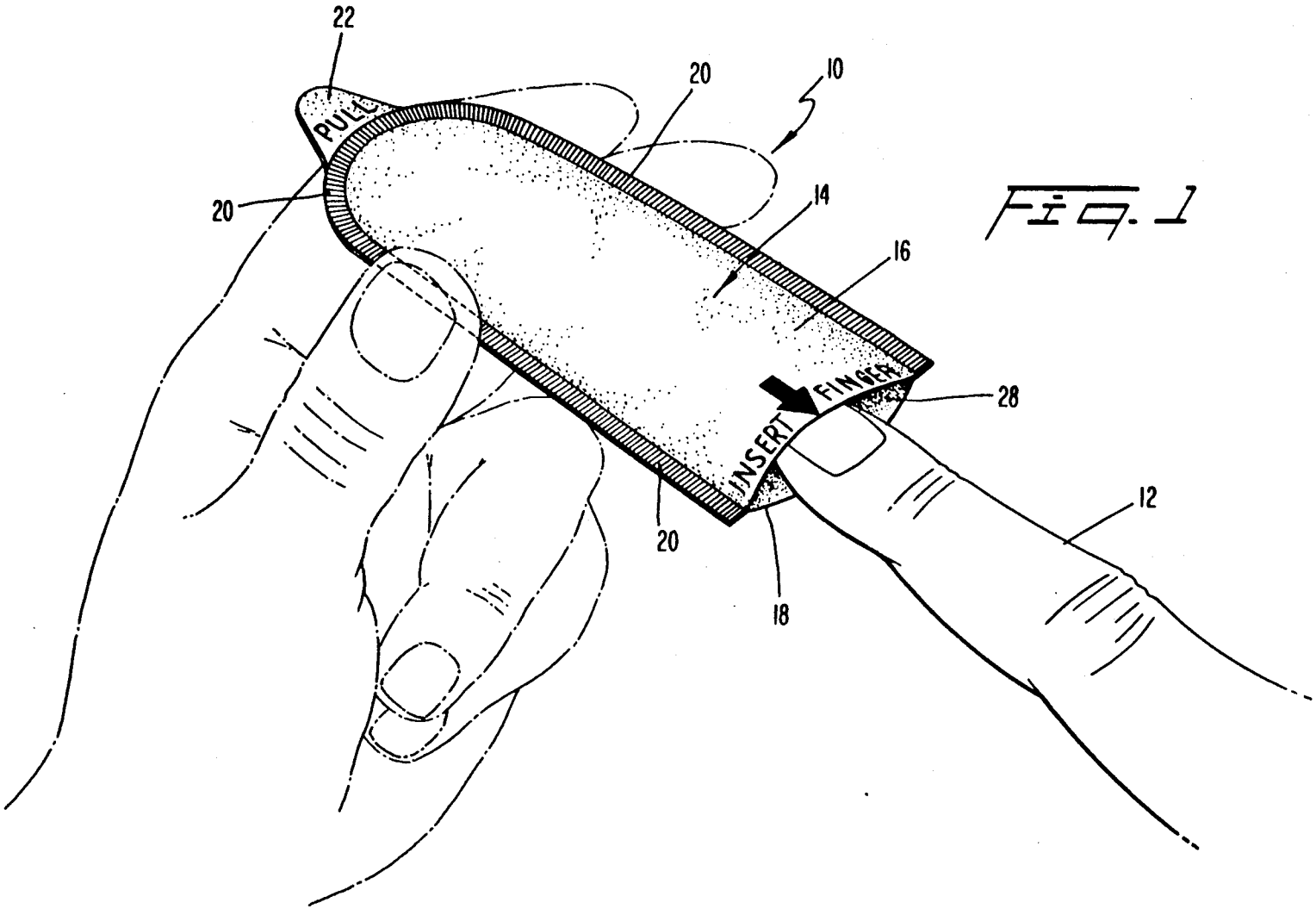
FIG. 1 is a perspective view showing a finger being inserted into the open end of the inner part of the novel toothbrush.

Referring now to FIG. 1, it will there be seen that an illustrative embodiment of the invention is denoted as a whole by the reference numeral 10.

Figure 2:
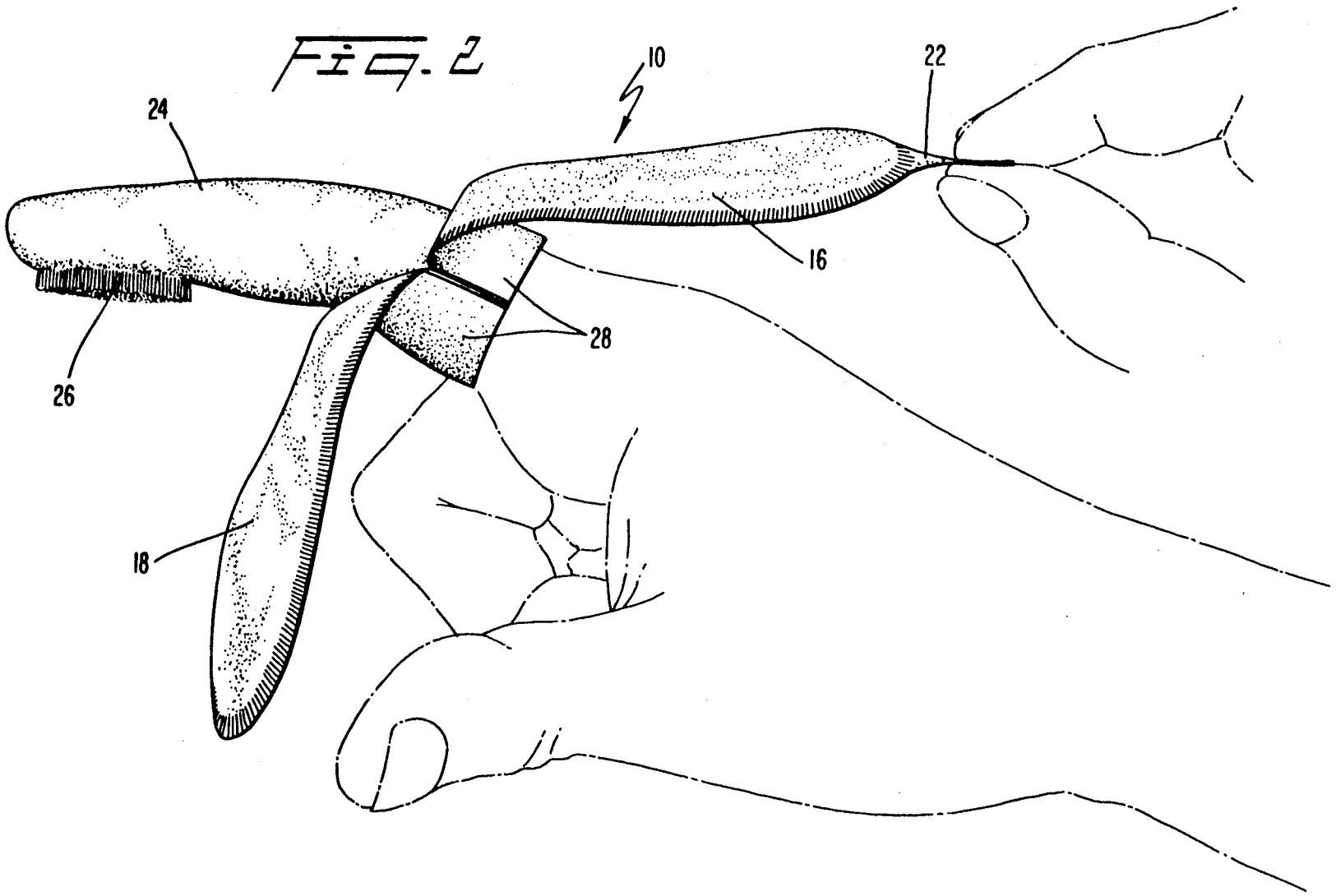
FIG. 2 is a perspective view showing a finger fully inserted into the inner part of the toothbrush and further showing the outer part of the toothbrush being peeled back so that it separates into two separate flaps.

Toothbrush 10, to be sold under the trademark SPIT SPOT disposable toothbrush, has a longitudinal extent substantially equal to that of a human finger 12 when in a folded, first storage configuration, as can be gleaned from FIG. 1. It includes outer part 14 that includes an upper flap 16 and a lower flap 18 that are releasably secured to one another about their respective flange-like outer peripheral borders 20 by heat-sealing or by a suitable adhesive means. The flange may be eliminated if desired, i.e., the outer peripheral borders of the upper and lower flaps may meet in the absence of a flange. Pull tab 22 is formed integral with upper flap 16 at the leading end thereof so that when said tab is peeled back as depicted in FIG. 2, lower flap 18 separates from the upper flap 16 and hangs down under the influence of gravity as depicted. Separation of said two flaps 16 and 18 exposes the bag-like inner part 24 of the device and hence bristles 26 fixedly secured thereto near the closed distal end thereof as shown. Significantly, because of the earlier-mentioned heat-sealed or adhesive seal, bristles 26 and inner part 24 are maintained in a clean, sanitary condition until pull tab 22 is pulled. Note from FIG. 2 that the respective lengths of flaps 16, 18 are substantially the same as the length of inner part 24. It should be clear, then, that inner part 24 is encased within outer part 14 when the device is in its first storage configuration and that an annular reverse fold or return bend 28 is formed where the outer and inner parts merge into one another.

Note also in FIG. 2 that inner part 24 has a bag-like construction as mentioned above, i.e., it is closed at its distal end and open at its proximal end to admit finger 12 thereinto. This open proximal end is held closed by the pull tab when the device is in its second storage configuration, hereinafter described.

Figures 3, 4:
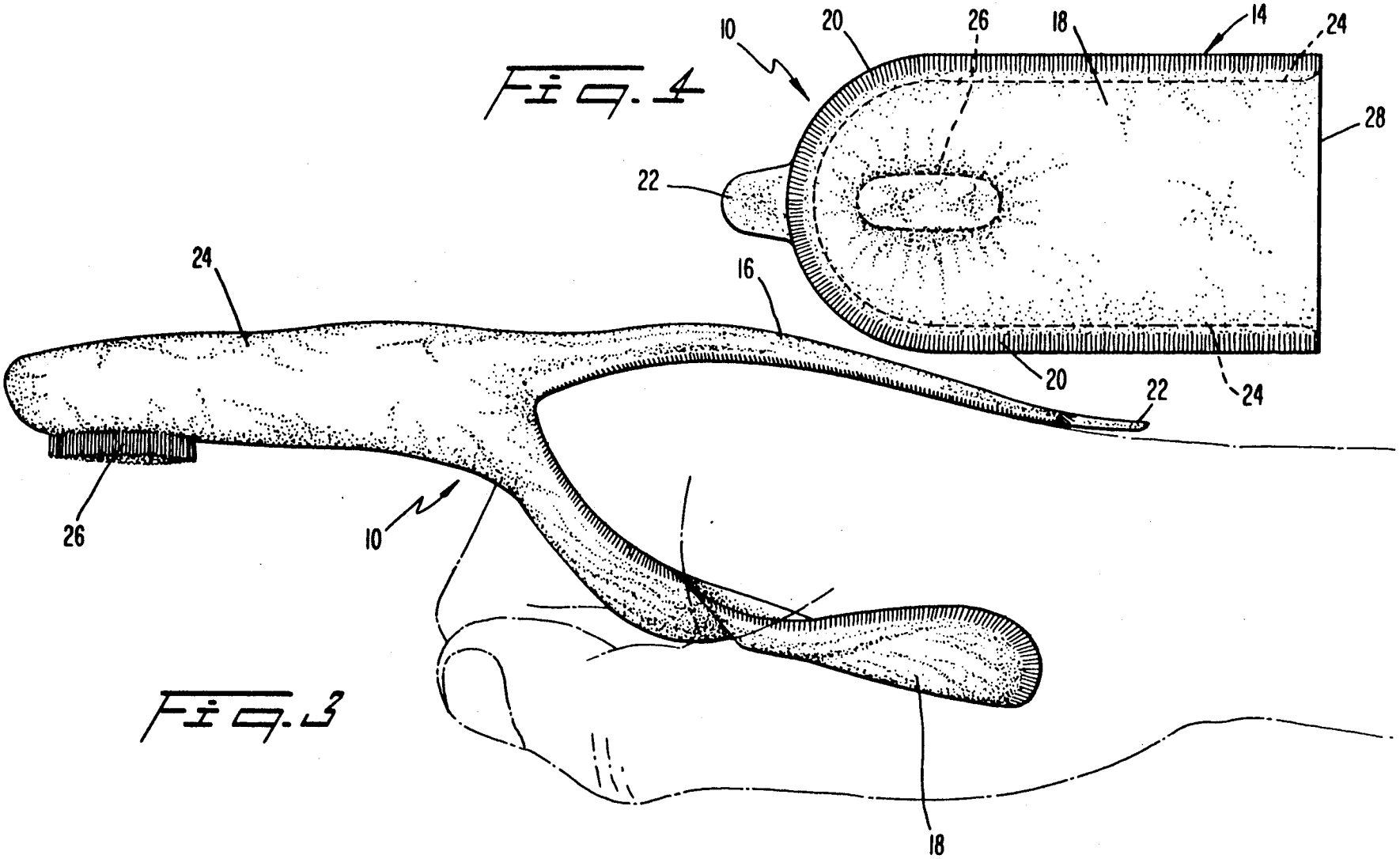
FIG. 3 is a perspective view showing how the lower flap is grasped by the user to maintain the toothbrush on the finger during use.
FIG. 4 is a bottom plan view of the toothbrush when in its first stored configuration.

FIG. 3 shows toothbrush 10 ready for use. Top flap 16 is shown disposed in overlying relation to the back of the user's hand, and lower flap 18 is shown being gripped by the user. Clearly, inner part 24 cannot slip off of finger 12 because said inner part is integral with flap 18. Users of the toothbrush 10 need not be told to grasp said lower flap 18 as a handle after peeling back upper flap 16 because the advantageous use to which said lower flap can be put is readily apparent. However, a commercial embodiment might include instructions that advise the user as to the proper use of the handle-flap 18.

The structure of the device may be understood perhaps even better in connection with FIG. 4. It will there be seen that inner part 24 is fully received within outer part 14 when device 10 is in its first flat, stored condition, i.e., inner part 24 is disposed in surrounded relation relative to outer part 14. The flat, flanged peripheral border 20 where top flap 16 is releasably secured to bottom flap 18 is also well depicted in this view.

A suitable material from which toothbrush 10 might be manufactured is a thin, lightweight, flexible, elastomeric material such as polyethylene. This allows it to be completely collapsed when stored and easily opened for finger insertion as depicted in FIG. 1. Moreover, such construction admits of easy sealing about peripheral border 20 and easy separation of the top and bottom flaps from one another when the device is to be used. The sanitary condition of bristles 26 is easily maintained until the device is opened, and the advantageous presence of lower flap 18 provides a unique means for keeping the device on the user's finger while the device is being used. All of these features combine to provide a consumer-friendly, affordable finger-mounted disposable toothbrush heretofore unknown, anywhere in the world.

Figure 5:
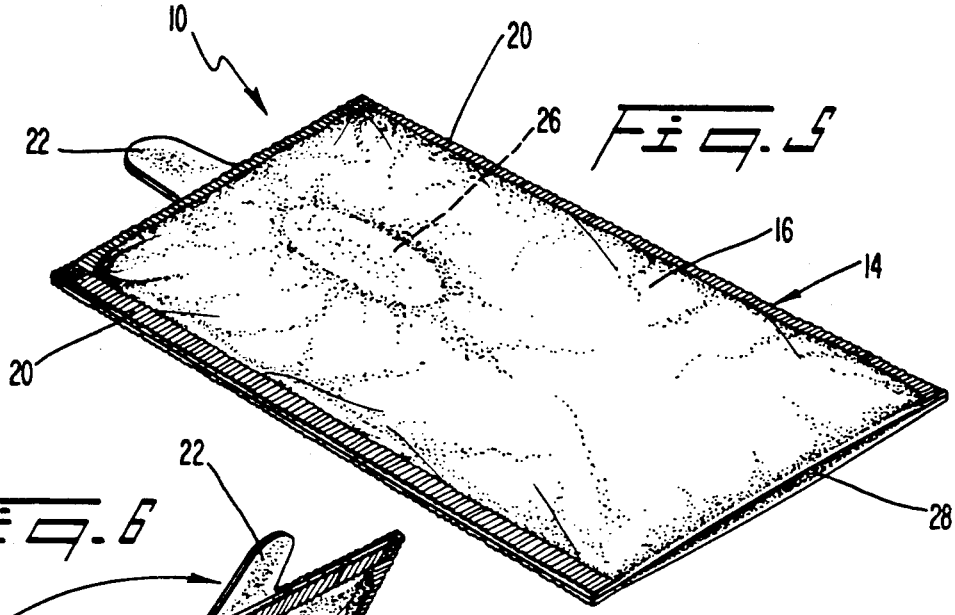
FIG. 5 is a perspective view of a second embodiment when in its first stored configuration.

A second embodiment of the invention is shown in FIG. 5; note that the leading end of the device is square in this embodiment, rather than rounded; this design may facilitate manufacturing of the device.

Figure 6:
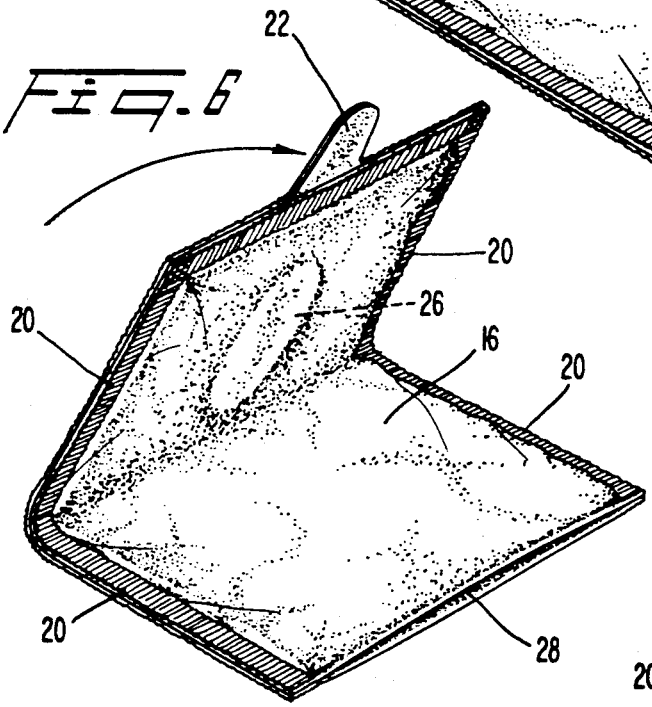
FIG. 6 is a perspective view showing the folding required to place either embodiment in its second stored configuration.
Figure 7:
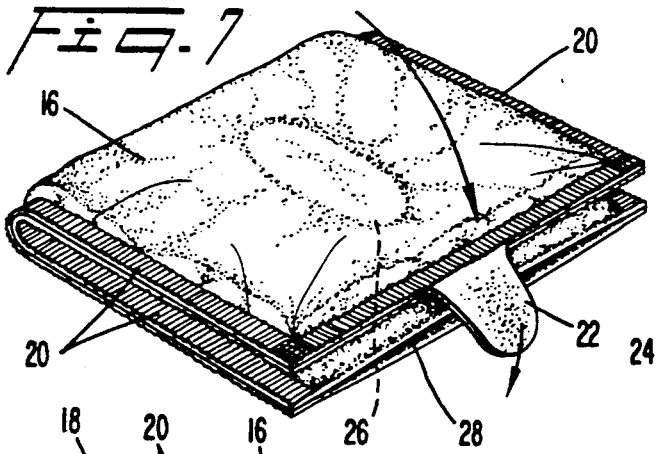
FIG. 7 is a perspective view of the second embodiment in its second stored configuration.
Figure 8:
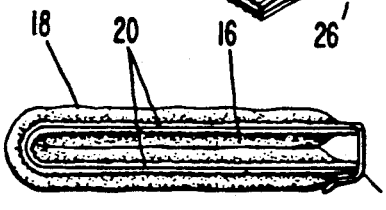
FIG. 8 is a side elevational view of the second embodiment in its second stored configuration.

FIGS. 6 and 7 depict how the second embodiment is folded to produce the second storage configuration of the device. The first embodiment may of course be folded the same way. More particularly, the fingerbrush is folded along a transverse folding line, about mid-length of the device, as depicted in FIG. 6, until it attains its FIG. 7 position. Note in FIG. 8 how pull tab 22 wraps around the open end of the device and helps hold it closed. A light adhesive may be applied to the outer part of the device adjacent said open end at the bottom thereof to hold the pull tab in its open end-closing position.

Figure 9:
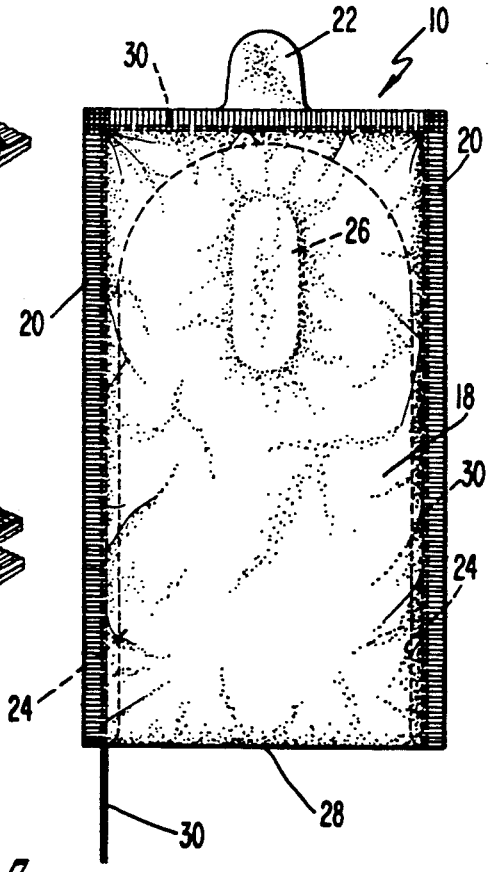
FIG. 9 is a view showing an embodiment that is opened by pulling on a string.

FIG. 9 shows an embodiment that is opened by pulling string 30.

This invention is clearly new and useful. Moreover, it was not obvious to those of ordinary skill in this art at the time it was made, in view of the prior art when considered as a whole in accordance with the requirements of law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A toothbrush of the type carried by a finger, comprising:

an inner part having a flexible, bag-like construction;

a plurality of bristles fixedly secured to said inner part near a distal end thereof;

an outer part formed integrally with said inner part and disposed in surrounding relation to said inner part;

said inner part and said outer part being formed of a common, thin, flexible, elastomeric material;

an annular return bend being formed where said inner part and said outer part merge with one another;

said outer part including an upper flap member and a lower flap member that are releasably sealed to one another about a peripheral border thereof;

said peripheral border having a flange-like structure;

a pull tab formed integrally with said upper flap at a leading end thereof to facilitate separation of said upper and lower flaps from one another; and said lower flap being grasped by the user of the toothbrush when the toothbrush is in use, said lower flap thereby serving as a handle;

whereby said bristles may be maintained in a clean condition as long as said outer part is disposed in surrounding relation to said inner part.

2. The toothbrush of claim 1, wherein said upper flap overlies the back of a user's hand when the toothbrush is in use.

3. The toothbrush of claim 2, wherein said toothbrush is substantially flat when in a first stored configuration prior to use.

4. The toothbrush of claim 3, wherein said inner part is wholly received within said outer part when the toothbrush is in a first stored configuration prior to use.

5. The toothbrush of claim 4, wherein said inner part and said outer part have a substantially common length that is substantially equal to the length of a human finger.

6. The toothbrush of claim 5, further comprising a second stored configuration of said toothbrush, said second stored configuration including a transverse fold line formed about mid-length of said toothbrush and said toothbrush being about one-half the length of a finger when in said second stored configuration.

7. The toothbrush of claim 1, further comprising a light adhesive applied to said toothbrush adjacent an open end thereof, said pull tab being releasably engaged by said adhesive and thereby holding closed, at least in part, said open end, when said toothbrush is in said second stored configuration.

* * * * *